US006280278B1

(12) United States Patent
Wells

(10) Patent No.: US 6,280,278 B1
(45) Date of Patent: Aug. 28, 2001

(54) SMOKE GENERATION SYSTEM FOR MODEL TOY APPLICATIONS

(75) Inventor: Chuck Wells, Newberg, OR (US)

(73) Assignee: M.T.H. Electric Trains, Columbia, MD (US)

( * ) Notice: Subject to any disclaimer, the term of this patent is extended or adjusted under 35 U.S.C. 154(b) by 0 days.

(21) Appl. No.: 09/354,799

(22) Filed: Jul. 16, 1999

(51) Int. Cl.[7] ..... A63H 19/14; B61D 17/00

(52) U.S. Cl. ..... 446/25; 446/24; 446/467; 105/1.5; 472/65

(58) Field of Search ..... 446/24, 25, 467; 40/406, 407; 472/52, 65; 105/1.5

(56) References Cited

U.S. PATENT DOCUMENTS

| | | | | |
|---|---|---|---|---|
| Re. 30,174 | | 12/1979 | Schedler . | |
| 1,683,760 | * | 9/1928 | Conners | 446/24 |
| 2,317,974 | | 5/1943 | Bastiansen . | |
| 2,413,284 | * | 12/1946 | Bonanno | 446/25 |
| 2,882,834 | | 4/1959 | Smith . | |
| 3,003,279 | * | 10/1961 | Bonanno | 446/25 |
| 3,664,060 | | 5/1972 | Longnecker . | |
| 3,839,822 | | 10/1974 | Rexford . | |
| 4,291,877 | | 9/1981 | Ensmann et al. . | |
| 4,303,397 | * | 12/1981 | Swiatosz | 446/24 |
| 4,374,038 | * | 2/1983 | Tamura . | |
| 4,450,772 | | 5/1984 | Van Sickle . | |
| 4,741,717 | * | 5/1988 | Wolf | 446/24 |
| 5,069,230 | * | 12/1991 | Green | 446/24 |
| 5,725,126 | * | 3/1998 | Poissant | 446/24 |
| 5,855,004 | * | 12/1998 | Novosel et al. | 704/272 |

FOREIGN PATENT DOCUMENTS

| | | | | |
|---|---|---|---|---|
| 2251391 | * | 8/1992 | (GB) | 446/251 |

* cited by examiner

*Primary Examiner*—Jacob K. Ackun, Jr.
*Assistant Examiner*—Bena B. Miller
(74) *Attorney, Agent, or Firm*—McDermott, Will & Emery

(57) ABSTRACT

A smoke generation system for use in model toys. The system includes a reservoir for holding smoke fluid, a heating element for converting the smoke fluid into smoke, a pump unit for delivering smoke fluid from the reservoir to the heating element, and a controller coupled to the pump unit. The controller functions to govern the operation of the pump unit so as to control the delivery of smoke fluid to the heating element, thereby controlling the density, volume and output rate of the smoke generated by the system.

41 Claims, 3 Drawing Sheets

10

SMOKE GENERATION SYSTEM FOR MODEL TOY APPLICATIONS

FIELD OF THE INVENTION

The present invention relates to smoke generation systems for use in model toys, and in particular to a puffing smoke system for use in model trains that provides for variable control of the density, volume and rate of smoke output by the smoke generation system so as to allow the smoke output to be controlled relative to the operation of the model train.

BACKGROUND OF THE INVENTION

Prior to the present invention, known model train smoke systems typically utilize a "wick-based" system for delivering the smoke fluid to a heating element, which vaporizes the smoke fluid, thereby creating smoke. More specifically, these "wick-based" systems include a wicking material, such as a fiberglass rope made out of a plurality of fine strands that are loosely wound together. One end of the wicking material is disposed in a reservoir containing the smoke fluid, and the other end of the wicking material is wrapped around the heating element, which is for example a resistor.

In operation, because the wicking material comprising a plurality of fine strands loosely wound together, a "capillary action" occurs which causes the smoke fluid to be absorbed by the portion of the wicking material disposed in the smoke fluid and delivered to the wicking material adjacent the heating element. In other words, the smoke fluid in the reservoir travels or "wicks" its way through the wicking material and is presented directly on or adjacent the heating element. When the smoke fluid is delivered to the heating element, the heating element causes the fluid to vaporize, thereby generating smoke. The smoke is then dispensed from the model train.

While the use of such wick-based smoke systems in model train applications has been widespread, there are significant disadvantages associated with these systems. One of the most significant disadvantages is that the design of the wicked-based system is such that the system is prone to destroy itself. More specifically, if the wick-based smoke system is operated without smoke fluid (which is highly likely to occur), in a short period of time the surface of the wicking material in contact with the heating element begins to overheat and melt. As a result, the wicking material becomes hardened and chard, and stops "wicking" (i.e., delivering smoke fluid from the reservoir to the heating element). When this occurs, the smoke system is rendered useless, and must be repaired/replaced. However, replacement of the wicking material is a time consuming and costly process.

Another disadvantage of wicked-based systems is that the systems do not allow for any control of the amount of smoke dispensed from the model train. The amount of smoke fluid delivered to the heating element is strictly a function of the "wicking" capabilities of the wicking material.

Accordingly, there exists a need for a smoke system that does not self-destruct in the event the system runs out of smoke fluid.

In addition, there exists a need for a smoke system that provides for continuous and variable control over the density, volume and output rate of the smoke generated by the system.

SUMMARY OF THE INVENTION

Accordingly, the present invention relates to a smoke generation system for use in model toys that provides for continuous and variable control over the density, volume and output rate of the smoke generated by the system, and that does not self-destruct in the event that the system is operated without smoke fluid.

More specifically, the present invention relates to a smoke generation system for use in model trains. The system comprises a reservoir for holding smoke fluid, a heating element for converting the smoke fluid into smoke, a pump unit for delivering smoke fluid from the reservoir to the heating element, a fan for dispensing smoke from a smoke corridor, and a controller coupled to the pump unit and the fan. The controller functions to govern the operation of the pump unit and the fan so as to control the delivery of smoke fluid to the heating element and the dispensing of the smoke from the smoke corridor, thereby providing continuous and variable control of the density, volume and output rate of the smoke generated by the system.

As described in detail below, the present invention provides important advantages over prior art devices. Most importantly, the present invention provides a smoke generation system that provides the ability to control and adjust the density, volume and output rate of the smoke generated by the system on a continuous basis. Accordingly, the system allows the smoke output of the toy train to be adjusted relative to the operation of the train. For example, if the train is going up a hill, the current load on the motor increases. In one embodiment of the present invention, the current load of the motor is monitored and utilized as the basis for adjusting the output of the smoke generation system. In fact, the present system provides for a smoke output appearance ranging from a low density steady stream to a high density independent puffing style output. As a result, the operation of the model train is made more realistic.

Another advantage of the present invention is that the smoke generation system does not destroy itself if the system is operated without smoke fluid. As such, the present invention significantly improves the reliability of smoke generation systems as compared to prior art systems.

Yet another advantage of the present invention is that it allows for precise control of the amount of smoke fluid provided to the heating element during a given "pump cycle". There is substantially no waste of the smoke fluid during operation of the system. As a result, the smoke generation system of the present invention having a fixed reservoir for holding smoke fluid can "smoke" for a substantially longer period of time than a prior art device having the same size smoke fluid reservoir.

Yet another advantage of the present invention is that because the smoke generation system of the present invention eliminates the use of the wicking material, for a given size smoke fluid reservoir, the present invention can hold more smoke fluid than prior art devices, thereby allowing for a longer "smoke" period for a single fill of the reservoir.

Additional advantages of the present invention will become apparent to those skilled in the art from the following detailed description of exemplary embodiments, which exemplify the best mode of carrying out the invention.

The invention itself, together with further objects and advantages, can be better understood by reference to the following detailed description and the accompanying drawings.

DETAILED DESCRIPTION OF THE INVENTION

A smoke generation system for use in model trains, which provides for continuous and variable control of the density, volume and output rate of the smoke generated by the system, is described below. In the following description, numerous specific details are set forth in order to provide a thorough and detailed understanding of the system of the present invention. It will be obvious, however, to one skilled in the art that these specific details need not be employed exactly as set forth herein to practice the present invention.

Figure 1:
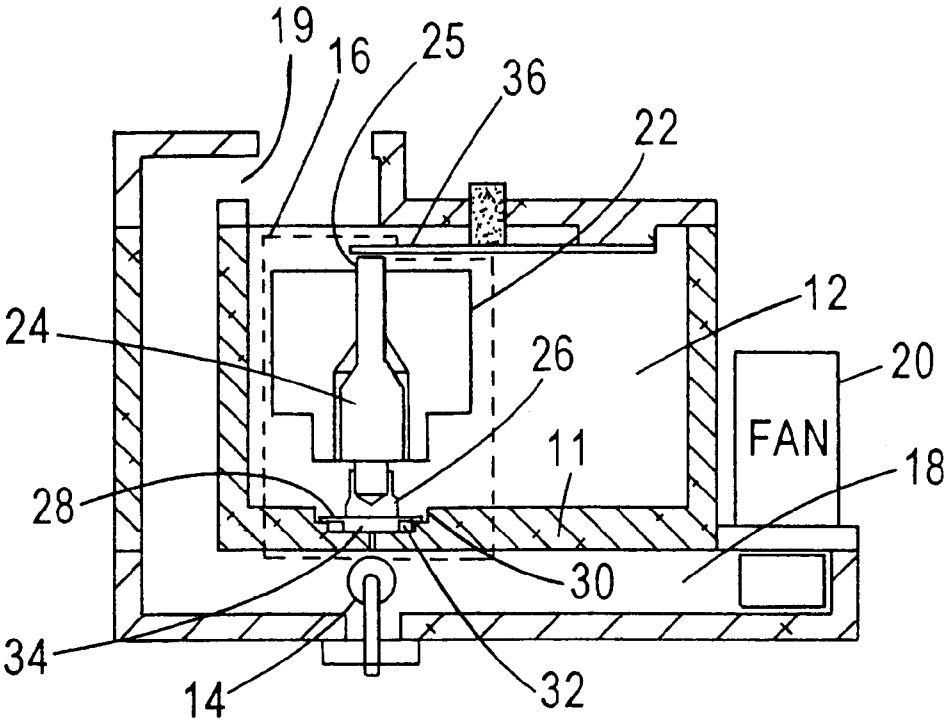
FIG. 1 illustrates a first exemplary embodiment of the smoke generation system of the present invention.

FIG. 1 illustrates a block diagram of a first exemplary embodiment of the smoke generation system of the present invention. Referring to FIG. 1, the system 10 comprises a reservoir 12 for holding smoke fluid, a heating element 14 for converting the smoke fluid into smoke, a pump unit 16 for delivering smoke fluid from the reservoir 12 to the heating element 14, and a controller (not shown in FIG. 1) coupled to the pump unit 16. The system 10 further comprises a smoke corridor 18, which has the heating element 14 disposed therein and a fan 20 coupled to the smoke corridor 18.

The pump unit 16 illustrated in FIG. 1, which is disposed in the reservoir 12, comprises a solenoid 22, a movable plunger 24, a lifting cup 26 attached to a first end of the plunger 24, a reed 28 disposed beneath the lifting cup 26 and within a cavity 30 formed in the bottom surface 11 of the reservoir 12, and an o-ring 32 disposed in the cavity 30. In the location of the cavity 30, the bottom surface 11 of the reservoir 12 also comprises an opening 34. The system 10 further comprises a biasing member 36, such as a spring, that functions to return the plunger 24 to a first (downward) position.

The operation of the smoke generation system 10 will now be described. As is known, the solenoid 22 is an electromechanical device that creates an electromagnetic field when an electric impulse or signal is applied thereto. In the instant application, the plunger 24 is capable of vertical movement within a channel formed by the solenoid 22. Specifically, when a signal/pulse is applied to the solenoid 22, the plunger 24, which is preferably a metal pin (e.g., steel), is attracted by the magnetic field generated by the solenoid and pulled upward within the channel. When the solenoid 22 is deactivated by removal of the signal, the plunger 24 is forced downward within the channel by means of the spring member 36 to the first position. The spring member 36 contacts the plunger 24 by a through pin 25 formed on the top of the plunger 24, which extends beyond the upper portion of the channel formed by the solenoid 22.

As stated above, a lifting cup 26, which in the current embodiment is a nylon button, is attached to the bottom end of the plunger 24. When the plunger 24 is in the downward position (i.e., solenoid deactivated), the lifting cup 26 contacts the reed 28 and forces the reed 28 downward into contact with the o-ring 32. In this downward position, the reed 28 and o-ring 32, which are both disposed in the cavity 30, form a seal which prevents smoke fluid contained in the reservoir 12 from entering the cavity 30. As such, when the plunger 24 is in the downward position, smoke fluid cannot pass from the reservoir 12 to the heating element 14, which can be for example a resistor. It is preferably that the lower surface of the lifting cup 26 is slightly concave so as to ensure 100% surface contact between the lower surface of the lifting cup 26 and the reed 28.

While not illustrated in FIG. 1, in the present embodiment both the reed 28 and the cavity 30 have a circular shape, and are positioned directly beneath the lifting cup 26. It is preferable that the reed 28 is also centered under the lifting cup 26 so as to ensure equal pressure being placed on the reed 28 when the lifting cup 26 is in the downward position. As stated above, the reed 28 is not attached to the lifting cup 26. The reed 28 is disposed in the cavity 30, which has a slightly larger diameter than the reed 28, so as to allow the reed 28 to move vertically within the cavity, while maintaining the reed 28 centered beneath the lifting cup 26. The diameter of the reed 28 must be large enough so that the reed 28 covers the o-ring 32 regardless of the position of the reed within the cavity 30. In the present embodiment, the o-ring 32 is disposed within the cavity 30 and engages the side walls of the cavity 30. The bottom portion of the side walls of the cavity 30 are slightly tapered so as to create friction between the o-ring 32 and the side walls so as to ensure that the o-ring 32 is maintained in the desired position within the cavity 30.

During operation, it is believed that the surface tension of the smoke fluid, which is typically a mineral oil based fluid, functions to keep the reed 28 and the lifting cup 26 in contact with one another. However, even assuming that the reed 28 and the lifting cup 26 separate during operation, the stroke of the solenoid plunger 24 is limited such that the reed 28 does not exit the cavity 30. In other words, the upward movement of the plunger 24 is limited such that the reed 28 remains within the cavity 30 during operation.

As stated above, the pump unit 16 is disposed within the reservoir 12. As the reservoir 12 is filled with the smoke fluid, the reed 28, the lifting cup 26, the plunger 24 and the solenoid 22 are immersed in the smoke fluid. When the solenoid 22 is activated by application of a signal generated by the controller 42, the plunger 24 and the lifting cup 26 are pulled upward rapidly. As this occurs, the cohesion of the smoke fluid between the lifting cup 26 and the reed 28, and the adhesion of the smoke fluid to the lifting cup 26 and the reed 28, cause the reed 28 to lift off the o-ring 32. When the reed 28 is lifted off the o-ring 32, smoke fluid flows into the cavity 30 by atmospheric pressure to fill the vacuum created by lifting the reed 28 rapidly. The solenoid 22 is then released (i.e., deactivated) and the return spring 36 forces the plunger 24, lifting cup 26 and the reed 28 downward rapidly onto the o-ring 32, thereby creating a pumping action. After a few successive, rapid actuations of the solenoid, the cavity 30 is filled with smoke fluid.

At this point in time, as liquids are essentially non-compressible, the reed 28 creates a pressure inside the cavity 30 when the reed 28 is rapidly forced downward by the return spring 36. According to the principles of hydraulics, this pressure is equally dispersed to all surfaces inside the cavity 30 including the surface area of the opening 34. As the opening 34 forms a through hole connecting the cavity 30 to the smoke corridor 18, the pressure in the cavity 30 formed by the downward motion of the reed 28 forces smoke fluid out of the opening 34 until zero pressure is attained. More specifically, the smoke fluid is squirted through the opening 34 into the smoke corridor 18 onto the heating element 14, thereby creating a puff of smoke.

When the solenoid 22 is activated again, the adhesion between the smoke fluid and the opening 34 functions as a check valve preventing air from being sucked through the opening 34 into the cavity 30. As the cohesion properties of the smoke fluid will not allow the smoke fluid to separate, a small vacuum forms because the smoke fluid in the cavity 30 has be reduced by the amount pumped out through the opening 34. Thus, when the solenoid 22 is activated again and the reed 28 lifted, smoke fluid is pushed around the reed 28 into the cavity 30 to equalize the vacuum created by the loss of smoke fluid displaced into the smoke corridor 18 as a result of the previous downward stroke of the plunger 24. Thus, by controlling the frequency of activation of the solenoid 22, it is possible to precisely control the pumping of smoke fluid onto the heating element 14, and therefore to precisely control the generation of smoke.

The fan 29, which is typically continuously running, creates an air flow directly across the heating element 14. As such, when a droplet of smoke fluid hits the resistor 14, it will vaporize into a smoke cloud that is carried through the smoke corridor 18 and out an opening 19 formed in the smoke corridor 18.

As is clear from the foregoing, the design of the pump of the present invention depends on the cohesion of the smoke fluid and the adhesion of the smoke fluid to the lifting cup 26 and reed 28 to accomplish its task. The amount of smoke fluid that is actually pumped is controlled by the following different factors. Viscosity of the smoke fluid is a major factor for determining the quantity of smoke fluid pumped per stroke of the solenoid 22. Another major factor is the ratio of the lifting cup 26 diameter to the reed 28 diameter. Specifically, the larger the diameter of the lifting cup relative to the reed diameter, the larger the volume of fluid pumped. Another factor in the volume of fluid pumped is the thickness of the reed. A thinner the reed results in an increase in the volume of fluid pumped. This is due to the flex of the reed after it returns to its seat on top of the o-ring 32 inside the cavity 30. Specifically, when the plunger 24 is returned by the spring 36, the reed 28 seals with the o-ring 32, the o-ring 32 compresses, and the reed 28 flexes downwardly. The flexing of the reed 28 causes a compression in the cavity 30 that results in the squirting of fluid through the opening 34. The pump unit 16 of the present embodiment is capable of pumping volumes in the range of 0.3 to 0.5 microliters. Of course, the dimensions of the pump components can be varied if other pumping volumes are desired.

The three most important factor for controlling the volume of the smoke fluid pumped are: 1) the frequency or rate of operation of the solenoid 22, 2) the duration of each individual stroke of the solenoid, and 3) the fan speed. With regard to the first factor, it is clear that the higher the rate of operation of the solenoid, the higher the volume of smoke produced by the pump.

Turning to the second factor, the duration of each stroke can also be controlled so as to vary the volume of smoke produced on a stroke by stroke basis. Specifically, the longer the stroke (i.e., the higher the plunger 24 is raised), the more fluid that squirted through the opening 34 and therefore the higher the volume of smoke produced each stroke. A shorter stroke results in a reduction in smoke volume produced by the pump each stroke.

Finally, by varying the fan speed, the smoke output by the model train can be varied from a steady stream to puffing (i.e., intermittent bursts of smoke). Specifically, the fan speed determines whether all or part of the smoke corridor 28 will be cleared between solenoid strokes. A higher fan speed can clear the smoke corridor 28 after every stroke of the solenoid 22, thereby creating a puffing output. A slower fan speed may not clear the smoke corridor 28 between solenoid strokes, and thereby result in steady stream of smoke being output from the smoke corridor. It is noted that in accordance with the present invention, the fan speed of the fan 20 is variable and controllable by the controller.

Accordingly, as the other aforementioned factors affecting the volume and density of the smoke fluid output by the pump are substantially fixed, the volume and density of smoke output by the model train can be controlled as desired by varying any of the three foregoing factors, all of which are simultaneously controllable and variable by the controller to achieve the desired smoke output.

Figure 2:
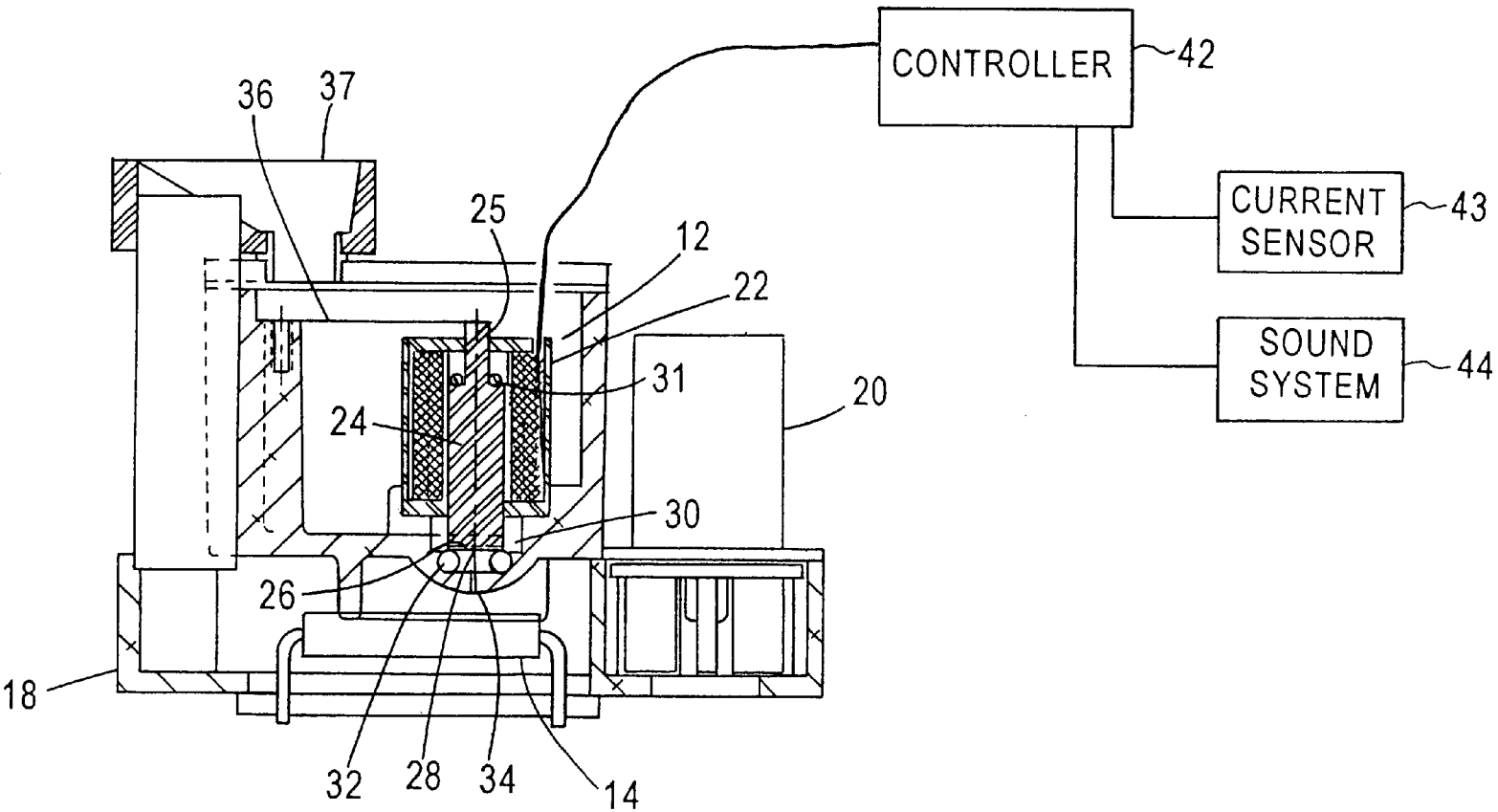
FIG. 2 illustrates a second exemplary embodiment of the smoke generation system of the present invention.

FIG. 2 illustrates a second embodiment of the smoke generation system of the present invention, which illustrates how the controller 42 is coupled to the solenoid 22. The reference numbers utilized to identify components in FIG. 1 are utilized to identify like components in FIG. 2. FIG. 2 also provides some additional details regarding the design of the smoke generation system of the present invention.

As shown in FIG. 2, the controller 42, for example, a microprocessor 42, is coupled to the solenoid so as to provide the necessary control signal to activate the solenoid. Of course, depending on the solenoid and microprocessor utilized, additional driver circuitry (not shown herein) may be necessary for the microprocessor to properly drive the solenoid. As the microprocessor is programmable, the frequency and duration of activation of the solenoid is readily controllable by the microprocessor. As such, the pumping action of the unit can be continuously and variably controlled by the microprocessor.

As shown in FIG. 2, the present invention also includes a plurality of sensors 43, 44 coupled to the microprocessor 42, so as to allow the microprocessor to control the pumping action in accordance with the measurements obtained by the sensors 43, 44. For example, in one embodiment, one sensor 43 monitors the current drawn by the motor of the model train. During operation, when the model train is going up a hill, the current load drawn by the train motor increases. This increase in current is detected by the sensor 43 and forwarded to the microprocessor 42, which in turn functions to increase the output of the smoke generation system. As a result, the operation of the model train is more realistic. It is noted that the pumping action of the system and/or the fan speed can be varied in accordance with any aspect of the train's performance capable of being monitored. One other example is a sensor 44 monitoring the speaker output of the model train.

Additional aspects of the embodiment shown in FIG. 2 include the fill tube 37 for pouring smoke fluid into the reservoir 12, and an additional o-ring 31 disposed on the upper surface of the plunger 24. The additional o-ring 37 functions to cushion the collision between the upper surface of the plunger and the upper surface of the solenoid when the solenoid is activated.

Figure 3:
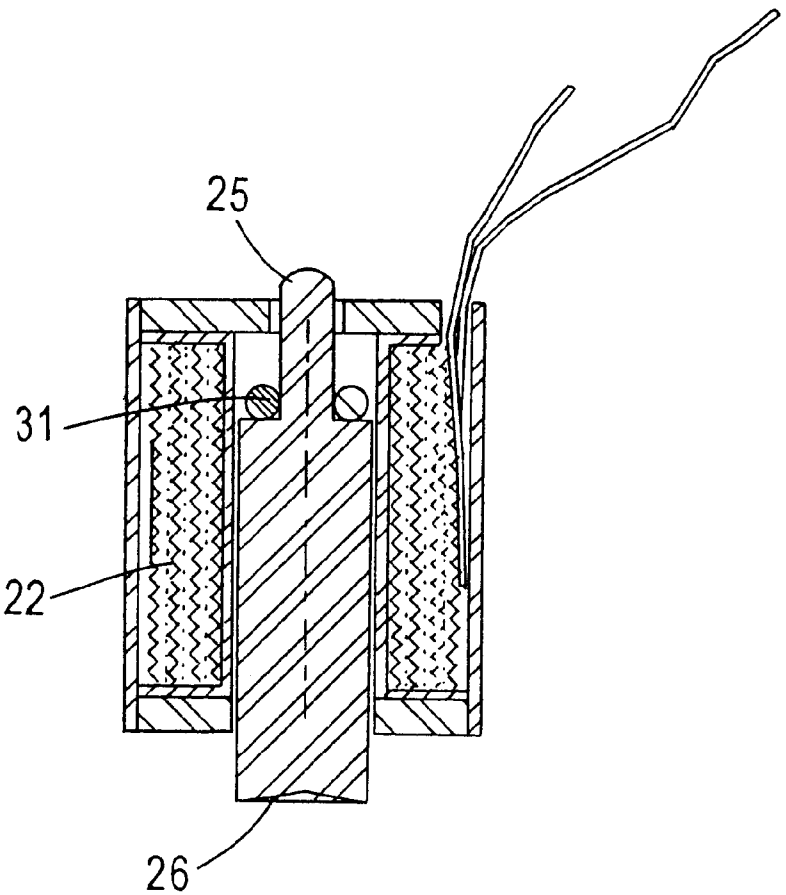
FIG. 3 is an expanded view of the plunger and solenoid illustrated in FIG. 2.

FIG. 3 is an expanded view of the plunger 24 and the solenoid 22 illustrated in FIG. 2. As shown therein, the lifting cup 26 is formed as an integral member of the plunger 24. In other words, the bottom surface of the plunger is formed to have a concave shape and functions as the lifting cup.

It is noted that while various sizes of the components forming the smoke generation system of the present invention can be utilized, the size of components utilized in an exemplary device are as follows. A solenoid used in the system has dimensions 7/16"×3/4" long, and has to overcome 4 oz. of return spring pressure, with a stroke of less than 0.050". The lifting cup has a 0.165" diameter and is made of nylon %. The reed is 0.008" thick feeler gauge cut and ground to 0.235" diameter. The o-ring disposed in the cavity is a metric 1-mm cross section ×3-mm inside diameter, and is made of buna-n. Buna-n is suitable for the smoker fluid oils typically utilized in the industry The opening is a 0.008" to 0.012" diameter hole in a stainless steel acorn nut. The reservoir body comprises 6061 aluminum.

As detailed above, the present invention provides important advantages over prior art systems. Most importantly, the present invention provides a smoke generation unit that provides the ability to control and adjust the density, volume and output rate of the smoke generated by the system on a continuous basis. Accordingly, the system allows the smoke output of the model train to be adjusted relative to the operation of the train. For example, if the train is going up a hill, the current load on the motor increases. The current load of the motor is monitored and utilized as the basis for adjusting the output of the smoke generation system. As a result, the operation of the train is more realistic.

Another advantage of the present invention is that the smoke generation system does not destroy itself if the system is operated without smoke fluid. As such, the present invention significantly improves the reliability of the smoke generation system as compared to prior art systems.

Yet another advantage of the present invention is that it allows for precise control of the amount of smoke fluid provided to the heating element during a given "pump cycle". There is substantially no waste of the smoke fluid during operation of the system. As a result, the smoke generation system of the present invention having a fixed reservoir for holding smoke fluid can "smoke" for substantially longer than a prior art device having the same size smoke fluid reservoir.

Yet another advantage of the present invention is that because the smoke generation system of the present invention eliminates the use of the wicking material, for a given size smoke fluid reservoir, the present invention can hold more smoke fluid than prior art devices, thereby allowing for a longer "smoke" period for a single fill of the reservoir.

Variations of the specific embodiments of the present invention disclosed herein are possible. The present embodiments are therefor to be considered in all respects as illustrative and not restrictive, the scope of the invention being indicated by the appended claims rather than the foregoing description, and all changes which come within the meaning and range of equivalency of the claims are therefor intended to be embraced therein.

I claim:

1. A smoke generation system for use in model toy, said system comprising:

a reservoir for holding smoke fluid, a heating element for converting said smoke fluid into smoke, a pump unit for delivering smoke fluid from said reservoir to said heating element, and a controller coupled to said pump unit, said controller governing the operation of said pump unit so as to control the delivery of smoke fluid to said heating element, wherein said pump unit comprises:

a solenoid coupled to said controller, said solenoid being activated by said controller, a plunger which is retractable from a first position by a magnetic field generated by said solenoid, a lifting cup attached to a first end of said plunger, a reed disposed beneath said lifting cup, and an o-ring disposed in a cavity formed in a bottom surface of said reservoir, wherein said o-ring and said reed form a seal when said plunger is in said first position.

2. The smoke generation system of claim 1, further comprising:

a smoke corridor for receiving the smoke generated by said heating element, and a fan disposed in said smoke corridor, said fan operative for dispensing smoke from said smoke corridor, said fan having a variable speed of operation which is controllable by said controller.

3. The smoke generation system of claim 2, wherein said controller allows for the adjustment of the density, volume and output rate of the smoke generated by said system on a continuous basis.

4. The smoke generation system of claim 3, wherein said controller varies the speed of operation of said fan so as to control the rate at which said smoke is dispensed from said smoke corridor.

5. The smoke generation system of claim 2, further comprising means for monitoring at least one operating condition of said model toy, said controller varying the operation of at least one of said pump unit and said fan in accordance with variations in said at least one operating condition.

6. The smoke generation system of claim 5, wherein said operating condition is a current level drawn by a motor in said model toy.

7. The smoke generation system of claim 5, wherein said operating condition is a power level utilized by said model toy.

8. The smoke generation system of claim 5, wherein said operating condition is the output of a sound system disposed in said model toy.

9. The smoke generation system of claim 1, wherein said cavity is coupled to said smoke corridor via an opening formed in a bottom surface of a reservoir.

10. The smoke generation system of claim 9, further comprising a spring member engaging a second end of said plunger, said spring member operative for returning said plunger to said first position upon deactivation of said solenoid.

11. The smoke generation system of claim 10, wherein when said plunger is returned to said first position smoke fluid is displaced from said reservoir via said opening into said smoke corridor and into contact with said heating element.

12. The smoke generation system of claim 1, wherein said controller is a microprocessor.

13. The smoke generation system of claim 1, wherein the pump unit is disposed within the reservoir.

14. The smoke generation system of claim 1, wherein said controller is electrical.

15. A smoke generation system for use in a model train, said system comprising:

a reservoir for holding smoke fluid, a heating element for converting said smoke fluid into smoke, a microprocessor, and a pump unit for delivering smoke fluid from said reservoir to said heating element, said pump unit comprising:

a solenoid coupled to said microprocessor, said solenoid being activated by said microprocessor, a plunger which is retractable from a first position by a magnetic field generated by said solenoid, a lifting cup attached to a first end of said plunger, a reed disposed beneath said lifting cup, and an o-ring disposed in a cavity formed in a bottom surface of said reservoir, wherein said microprocessor governs the operation of said pump unit so as to control the delivery of smoke fluid to said heating element.

16. The smoke generation system of claim 15, further comprising:

a smoke corridor for receiving the smoke generated by said heating element, and a fan disposed in said smoke corridor, said fan operative for dispensing said smoke from said smoke corridor, said fan having a variable speed of operation which is controllable by said microprocessor.

17. The smoke generation system of claim 16, wherein said microprocessor allows for the adjustment of the density, volume and output rate of the smoke generated by said system on a continuous basis.

18. The smoke generation system of claim 16, wherein said microprocessor varies the speed of operation of said fan so as to control the rate at which said smoke is dispensed from said smoke corridor.

19. The smoke generation system of claim 16, further comprising means for monitoring at least one operating condition of said model train, said microprocessor varying the operation of at least one of said pump unit and said fan in accordance with variations in said at least one operating condition.

20. The smoke generation system of claim 19, wherein said operating condition is a current level drawn by a motor in said model train.

21. The smoke generation system of claim 19, wherein said operating condition is a power level utilized by said model train.

22. The smoke generation system of claim 19, wherein said operating condition is the output of a sound system disposed in said model train.

23. The smoke generation system of claim 19, wherein said operating condition is movement by said model train.

24. The smoke generation system of claim 19, wherein said operating condition is a direction of movement by said model train.

25. The smoke generation system of claim 15, wherein said cavity is coupled to a smoke corridor via an opening formed in said bottom surface of said reservoir.

26. The smoke generation system of claim 15, further comprising a spring member engaging a second end of said plunger, said spring member operative for returning said plunger to said first position upon deactivation of said solenoid.

27. The smoke generation system of claim 15, wherein when said plunger is returned to said first position smoke fluid is displaced from said reservoir via an opening into a smoke corridor and into contact with said heating element.

28. A smoke generation system for use in model toy, said system comprising:

a reservoir for holding smoke fluid, a heating element for converting said smoke fluid into smoke, a pump unit for delivering smoke fluid from said reservoir to said heating element, a controller coupled to said pump unit, said controller governing the operation of said pump unit so as to control the delivery of smoke fluid to said heating element, and means for monitoring at least one operating condition of a model toy, said controller varying the operation of said pump unit in accordance with variations in said at least one operating condition.

29. The smoke generation system of claim 28, further comprising a smoke corridor for receiving the smoke generated by said heating element, and a fan disposed in said smoke corridor, said fan operative for dispensing smoke from said smoke corridor, said fan having a variable speed of operation which is controllable by said controller.

30. The smoke generation system of claim 29, wherein said controller allows for the adjustment of the density, volume and output rate of the smoke generated by said system on a continuous basis, and for control over the speed of operation of said fan so as to control the rate at which said smoke is dispensed from said smoke corridor.

31. The smoke generation system of claim 30, said controller varying the operation of said fan in accordance with variations in said at least one operating condition.

32. The smoke generation system of claim 31, wherein said operating condition is a current level drawn by a motor in said model toy.

33. The smoke generation system of claim 31, wherein said operating condition is a power level utilized by said model toy.

34. The smoke generation system of claim 31, wherein said operating condition is the output of a sound system disposed in said model toy.

35. The smoke generation system of claim 31, wherein said operating condition is movement by said model toy.

36. The smoke generation system of claim 31, wherein said operating condition is a direction of movement by said model toy.

37. A smoke generation system for use in model toy, said system comprising:

a reservoir for holding smoke fluid, a heating element for converting said smoke fluid into smoke, a pump unit for delivering smoke fluid from said reservoir to said heating element, a controller coupled to said pump unit, said controller governing the operation of said pump unit so as to control the delivery of smoke fluid to said heating element, a smoke corridor for receiving the smoke generated by said heating element, a fan disposed in said smoke corridor, said fan operative for dispensing smoke from said smoke corridor, said fan having a variable speed of operation which is controllable by said controller, and means for monitoring at least one operating condition of said model toy, said controller varying the operation of at least one of said pump unit and said fan in accordance with variations in said at least one operating condition.

38. The smoke generation system of claim 37, wherein said operating condition is a current level drawn by a motor in said model toy.

39. The smoke generation system of claim 37, wherein said operating condition is a power level utilized by said model toy.

40. The smoke generation system of claim 37, wherein said operating condition is the output of a sound system disposed in said model toy.

41. The smoke generation system of claim 37, wherein the pump unit is disposed within the reservoir.

* * * * *